US005110314A

United States Patent [19]

Fujihara et al.

[11] Patent Number: 5,110,314

[45] Date of Patent: May 5, 1992

[54] DEVICE FOR INCLINING THE TIP PATH PLANE OF A PROPELLER OF TOY HELICOPTER

[75] Inventors: Yuji Fujihara; Masaru Ando, both of Osaka, Japan

[73] Assignee: Keyence Corporation, Osaka, Japan

[21] Appl. No.: 610,652

[22] Filed: Nov. 8, 1990

[30] Foreign Application Priority Data

Nov. 14, 1989 [JP] Japan ..... 1-296866

[51] Int. Cl.[5] ..... A63H 17/00

[52] U.S. Cl. ..... 446/34; 446/36; 446/37

[58] Field of Search ..... 446/34, 36, 37, 176, 446/178, 179

[56] References Cited

U.S. PATENT DOCUMENTS

D. 158,936 6/1950 Crowder ..... 446/36 X
158,937 6/1950 Crowder ..... 446/36 X
3,108,641 10/1963 Taylor ..... 446/37 X
3,857,194 12/1974 Guttman ..... 446/36
4,272,041 6/1981 Mabuchi et al. ..... 446/37 X
4,981,456 1/1991 Sato et al. ..... 446/36

FOREIGN PATENT DOCUMENTS 815023 7/1949 Fed. Rep. of Germany ..... 446/37

*Primary Examiner*—Robert A. Hafer
*Assistant Examiner*—Sam Rimell
*Attorney, Agent, or Firm*—Sughrue, Mion, Zinn, Macpeak & Seas

[57] ABSTRACT

In a propeller blade tip path plane-inclining device for a toy helicopter, a propeller is disposed asymmetrically with respect to a rotation shaft, and the position of the propeller in the plane of rotation of the propeller is detected, and the speed of rotation of the propeller is increased and decreased at predetermined regions so as to change the flexing of the propeller caused by a difference in the rotational speed, so that the propeller blade tip path plane is inclined, thereby determining the direction of the force of propulsion of a fuselage.

6 Claims, 7 Drawing Sheets

DEVICE FOR INCLINING THE TIP PATH PLANE OF A PROPELLER OF TOY HELICOPTER

BACKGROUND OF THE INVENTION

The present invention relates to a propeller blade tip path plane-inclining device for use in a toy having a propeller as a pusher, particularly a model helicopter or the like.

In a helicopter or the like in which the rotation of a propeller lifts the fuselage and produces a propulsive force to fly the helicopter, propulsive force in a desired direction is obtained by inclining the plane of rotation of the propeller, thereby driving the helicopter.

The inclining of the propeller rotation plane is effected by various methods, one example of which is illustrated in FIG. 12.

Blades v of identical shape are symmetrically mounted on a rotation shaft u connected to a motor (not shown) mounted within a fuselage t. A swash plate w is composed of two disks, which constitute a rotatable portion w1 and a non-rotatable portion w2, respectively. One end of each of the blades v is connected to this rotatable portion through respective pitch links x.

The non-rotatable portion of the swash plate w2 can be inclined by control rods y, and the rotatable portion of the swash plate w1 can be inclined together with the non-rotatable portion w2.

When the swash plate is inclined by operating the control rods y, the rotating blades v are periodically varied in pitch, so that the plane of rotation of the blades v is inclined relative to the rotation shaft u.

The propeller rotation plane-inclining device of the above construction requires the inclining mechanism composed of the swash plate w, the pitch links x and the control rods v, and hence the device is complicated and the assembly operation is cumbersome.

Further, a model helicopter or the like is required to be of a small size and light in weight so as to more easily lift the fuselage to allow the helicopter to fly. In the case where the above complicated device is incorporated, these requirements are difficult to meet. Moreover, the overall cost is high.

SUMMARY OF THE INVENTION

With the above problems in view, it is an object of the invention to provide a propeller blade tip path plane-inclining device for a toy helicopter in which the propeller blade tip path plane can be inclined by an electrical control to achieve accurate drivability, the number of component parts is reduced to achieve a small-sized and lightweight design, and the cost is low.

This, as well as other objects of the invention, are met by a propeller blade tip path plane-inclining device for use in a toy helicopter, comprising a fuselage, a propeller which is asymmetrical with respect to a rotation shaft and imparts a vertical upward propulsive force to the fuselage, a motor for driving the propeller for rotation, a position detector for detecting the position of the propeller in the propeller rotation plane, and a control circuit for outputting a pulse signal for driving the motor, and for increasing and decreasing the width of the pulse signal at predetermined regions of the propeller rotation plane so as to vary motor speed proportional to pulse width in accordance with a signal from the position detector.

DESCRIPTION OF THE PREFERRED EMBODIMENTS

The invention will now be described in detail with reference to illustrated embodiments of the invention.

Figure 1:
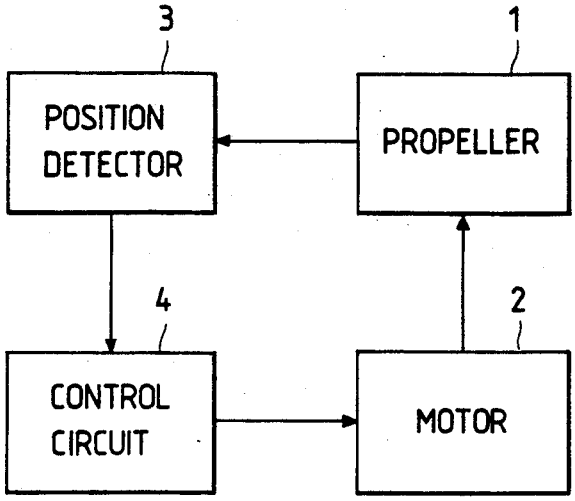
FIG. 1 is a schematic block diagram of a propeller rotation plane-inclining device of the present invention.

FIG. 1 is a schematic block diagram of a propeller blade tip path plane-inclining device for a toy helicopter, provided in accordance with the present invention.

Figure 2:
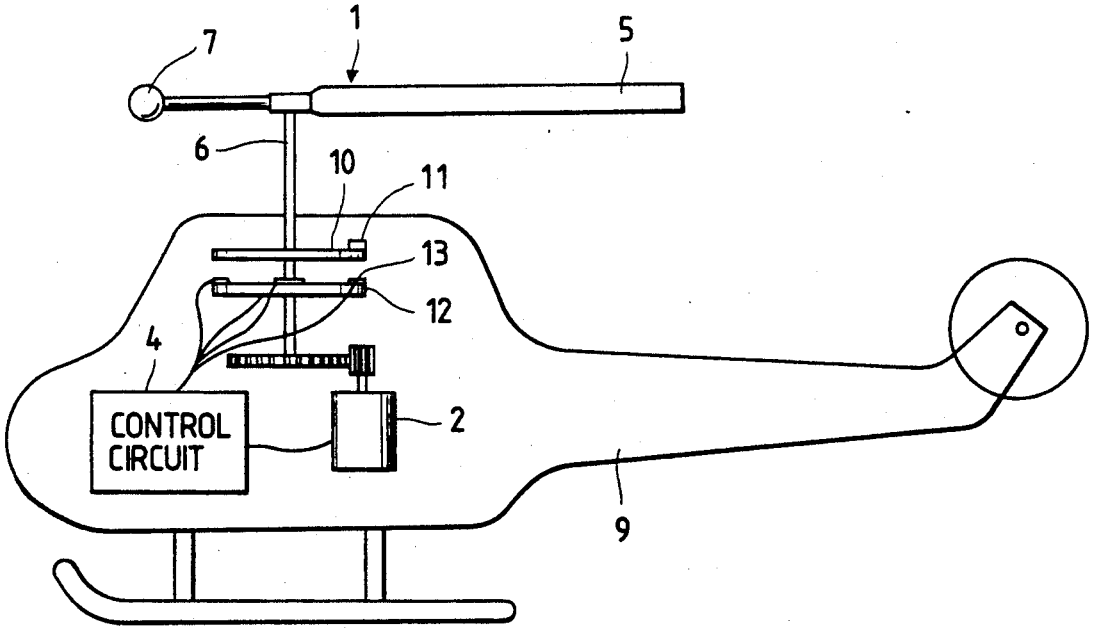
FIG. 2 is a view of a first embodiment of the invention.

The device of the present invention includes a propeller 1 which is asymmetrical with respect to a rotation shaft and imparts a vertical upward propulsive force to a fuselage, a motor 2 for driving the propeller 1 for rotation, a position detector 3 for sensing the position of the propeller 1 during rotation of the propeller, and a control circuit 4 for outputting a pulse signal for driving the motor 2 and for increasing and decreasing the width of the pulse signal at predetermined regions of the propeller tip path plane so as to vary the speed of motor rotation plane in accordance with a signal from the position detector FIG. 2 is a view illustrative of a first embodiment of the invention.

The propeller 1 has one blade 5 extending horizontally from the rotation shaft 6 in one direction, and a weight 7 projecting in a direction opposite to the blade 5. The weight 7 serves to balance the blade 5. The blade 5 is made of a soft material such as a synthetic resin, and is so flexible that in a stationary condition, the distal end of the blade 5 is flexed downward under its own weight.

The motor 2 is mounted within the fuselage 9, and drives the propeller 1 for rotation either directly or via gearing or the like.

The position detector 3 has a rotatable plate 10 rotatable together with the rotation shaft 6 of the propeller 1, and a fixed plate 12 fixed to the fuselage 9.

A magnet 11 is mounted on the rotatable plate 10, and a plurality of magnetic sensors 13 are mounted on the fixed plate 12 fixed to the fuselage 9 and disposed close to the rotatable plate 10, the magnetic sensors 13 being disposed in registry with a circular path of rotation of the magnet 11.

A detection signal from each magnetic sensor 13 is inputted to the control circuit 4, and the control circuit 4 is responsive to this detection signal to produce a pulse signal, thereby controlling the rotation of the motor 2. Power for the various components advantageously can be provided by an conventional power supply.

Figure 3:
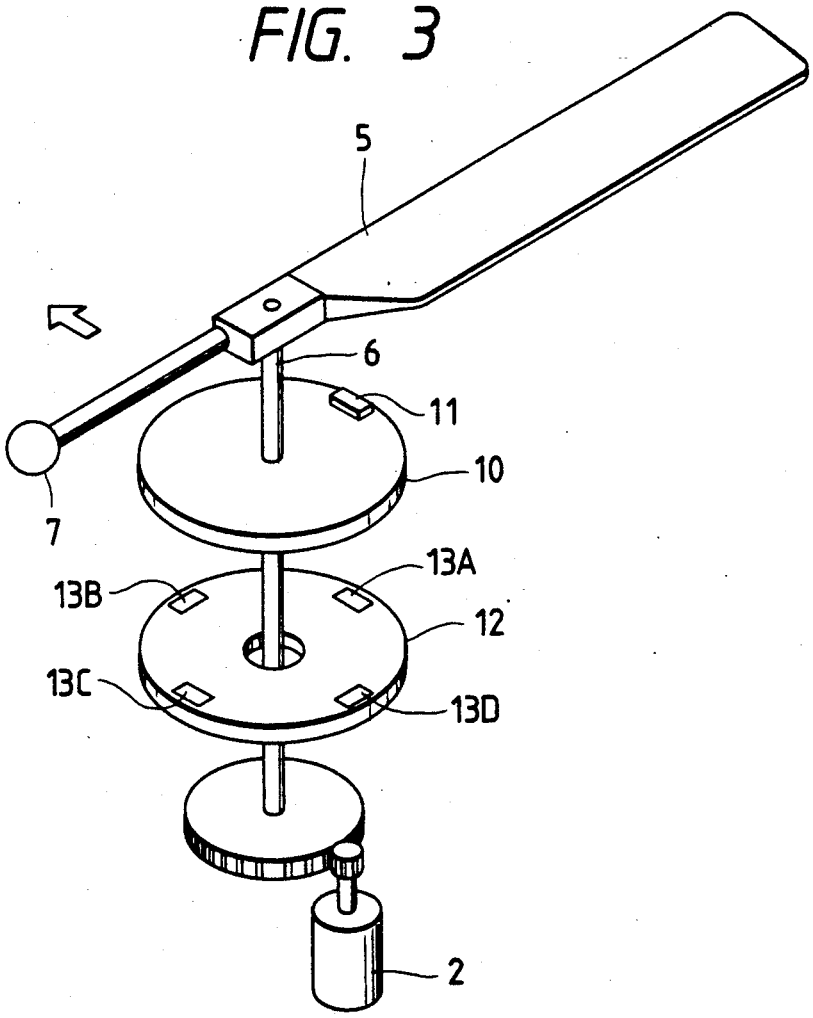
FIG. 3 is a perspective view of an important portion of the first embodiment of the invention.

FIG. 3 is a perspective view of an important portion of the first embodiment, and an arrow indicates the front side of the fuselage 9.

The magnet 11 is attached to the rotatable plate 10 in the same direction as that of the blade 5, as viewed in the longitudinal direction of the rotation shaft 6. The magnetic sensors 13 are arranged at equal intervals at four positions directed respectively to the front, rear and right and left sides of the fuselage 9, as viewed in the longitudinal direction of the rotation shaft 6. Here, the magnetic sensors disposed respectively at the right side position, the front side position, the left side position and the rear side position of the fuselage 9 as viewed in the longitudinal direction of the rotation shaft 6 are designated by reference numerals 13A, 13B, 13C and 13D, respectively.

Each magnetic sensor 13 outputs a detection signal when the magnet 11 mounted on the rotatable plate 10 approaches the magnetic sensor 13. Each magnetic sensor 13 generates one pulse signal per rotation of the rotatable plate 10.

Figure 4:
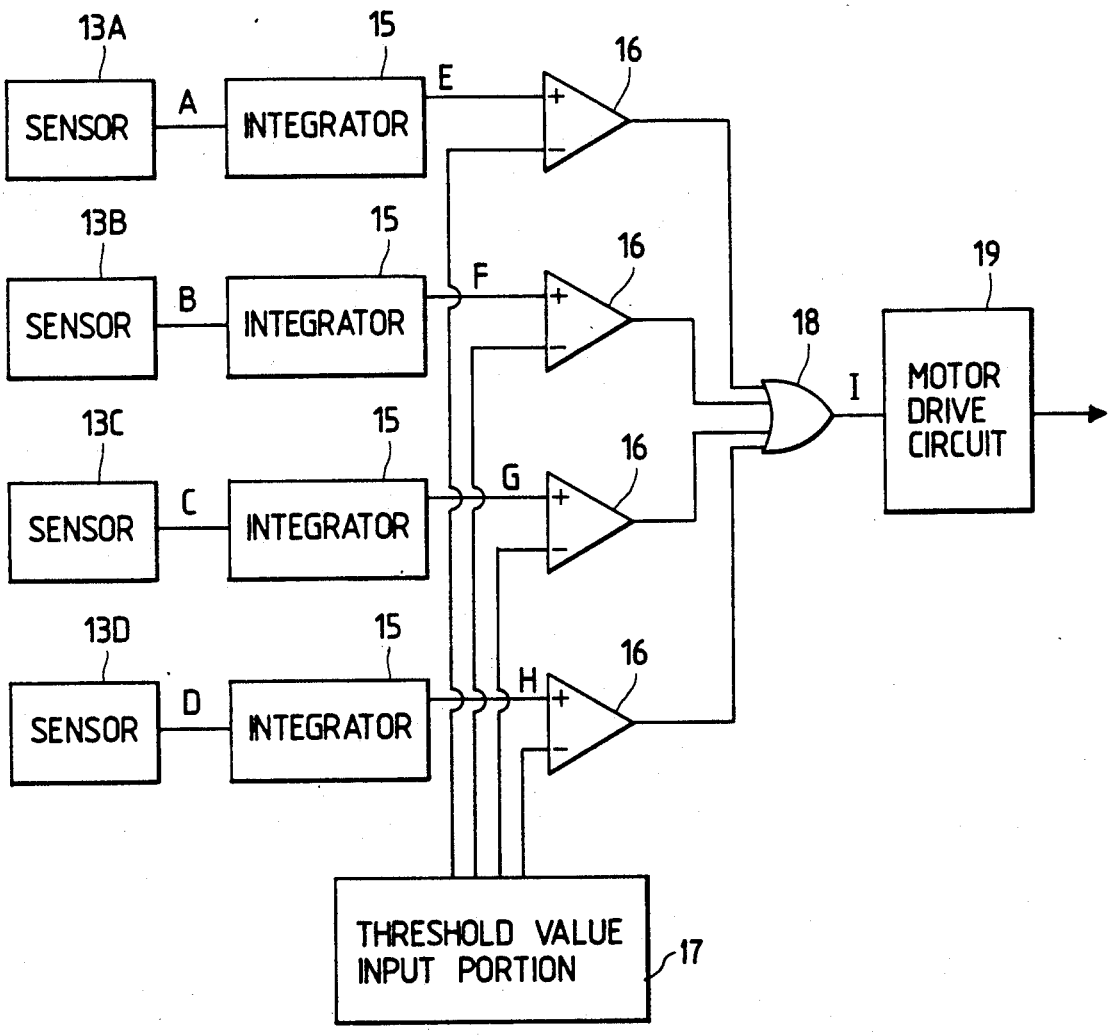
FIG. 4 is a schematic block diagram of a control circuit used in the first embodiment of the invention.

FIG. 4 is a schematic block diagram of the control circuit 14.

The detection signals A, B, C and D inputted respectively from the magnetic sensors 13A, 13B, 13C and 13D are converted by respective integrators 15 into triangular waves E, F, G and H, and then are inputted to respective comparators 16. A threshold value corresponding to the inclination angle of the tip path plane is inputted from a threshold value input portion 17 to each comparator 16, and the comparator 16 outputs a pulse signal having a width determined by this threshold value.

The outputs of the comparators 16 are ORed by an OR circuit 18 to produce a pulse signal I, and a motor drive circuit 19 drives the motor 2 in accordance with this pulse signal I. It will be noted that the greater the pulse width, the greater will be the speed of motor 2 at the end of the applied pulse.

Figure 5:
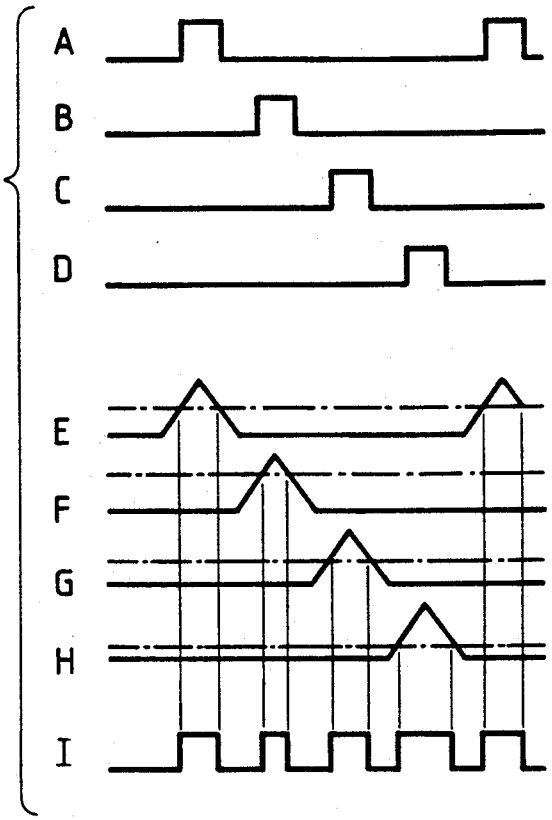
FIG. 5 is a timing chart for the control circuit of the first embodiment of the invention.

FIG. 5 is a timing chart for the control circuit 4.

The detection signal A is outputted from the right side position sensor 13A. Namely, the right side position sensor 13A generates the pulse signal when the blade 5 comes to the right side of the fuselage 9. Similarly, the detection signal B from the front side position sensor 13B, the detection signal C from the left side position sensor 13C, and the detection signal D from the rear side position sensor 13D respectively generate pulse signals when the blade 5 comes to the front side position, the left side position and the rear side position of the fuselage 9.

The detection signals A, B, C and D outputted respectively from the magnetic sensors 13A, 13B, 13C and 13D are shaped by the respective integrators 15 into the triangular waves E, F, G and H.

The threshold value applied to each comparator 16 is determined or set in accordance with the desired angle of inclination of the propeller blade tip path plane. When the threshold values applied respectively to the four comparators 16 are the same, the widths of the pulse signals obtained from the comparators 16 are the same, so that the plane of tip plane of the blade 5 is uniform, thereby producing propulsive force acting in a direction parallel to the rotation shaft 6.

For example, as indicated by dot-and-dash lines in FIG. 5, if the threshold value for the signal F produced when the blade 5 is at the front side position of the fuselage 9 is greater than the others, and also if the threshold value for the signal H produced when the blade 5 is at the rear side position of the fuselage 9 is smaller than the others, then the resulting pulse signal I for driving the motor is as shown in FIG. 5.

Namely, when the blade 5 is at the front side position of the fuselage 9, the pulse width is small, and when the blade 5 is at the rear side position of the fuselage 9, the pulse width is large. As a result, rotation irregularities develop during one rotation of the blade 5.

The blade 5 is flexed from its proximal portion due to its own weight, and the lower the rotational speed, the greater the degree of flexing.

It is now assumed that the blade 5 rotates in a counterclockwise direction. When the speed of rotation of the blade 5 is low at the front side position of the fuselage 9, flexing begins from this position, and the degree of flexing becomes a maximum when the blade 5 comes to the left side position of the fuselage 9.

On the other hand, the rotational speed is a maximum when the blade 5 comes to the rear side position of the fuselage 9, and therefore the distal end portion of the blade 5 begins to rise from this position, and reaches the uppermost position when the blade 5 comes to the right side position of the fuselage 9.

However, the positions where the degree of flexing of the blade 5 becomes the maximum and the minimum are influenced by the speed of response of the motor, and these factors are also controlled. As previously noted, the speed of motor 2 is proportional to the pulse width of the pulses generated by comparators 16.

Figure 6:
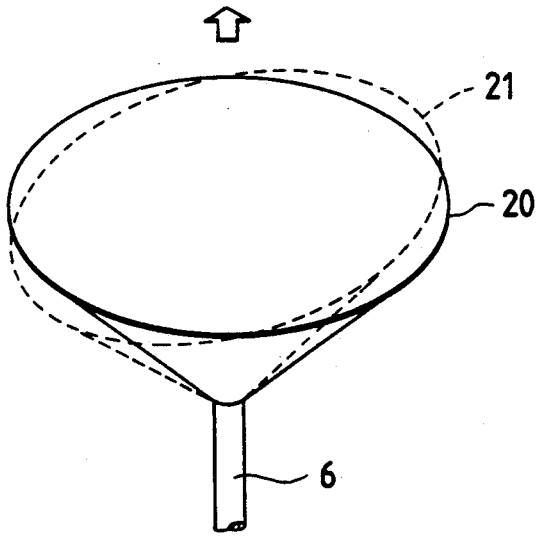
FIG. 6 is a view illustrative of propeller tip path planes.

FIG. 6 shows orbits of rotation of the distal end of the blade 5.

As shown in FIG. 6, the orbit of rotation of the distal end of the blade 5 is inclined to the left, as indicated at 21, relative to the orbit 20 obtained when the pulse width is uniform (the direction of an arrow in FIG. 6 is the front side), and the fuselage 9 receives the propulsive force acting in the left direction.

Figure 6A:
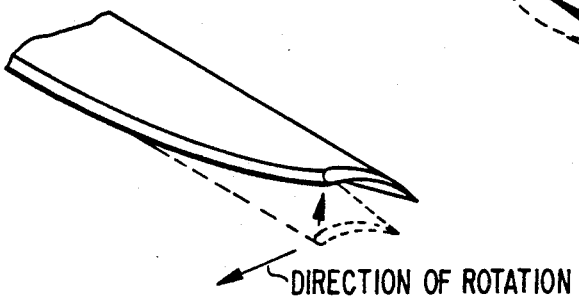
FIG. 6A is an illustrative view of the propeller blade for explaining tip path inclination.

When the propeller of the toy helicopeter rotates, the distal end of the blade bends, as shown in FIG. 6A, due to air pressure in accordance with the rotational speed of the blade. The path traveled by the blade tip constitutes the tip path plane, as shown in FIG. 6. The tip path is maintained in a balanced condition with resect to the torational speed of the blade and air pressure, as indicated by the solid line in FIG. 6. If the rotational speed is constant, the tip path is perpendicular to the rotational axis of the propeller. According to the present invention, an inclination of the tip path can be controlled by cyclically varying the rotational speed of the blade as shown, for sample, in FIG. 6 by a dashed line, since the degree at which the distal end of the blade varies in accordance with the rotational speed of the blade.

Although an example in which the plane of rotation of the blade 5 is inclined left has been described, the inclination in every direction can be similarly controlled. This can be easily achieved by changing the threshold values applied to the comparators 16.

The number of magnetic sensors 13 is not limited to that in this particular embodiment, and more precise and complicated control can be achieved by increasing the number of magnetic sensors 13.

Although magnetic sensors 13 are used, photoelectric switches for detecting specific positions on the rotatable plate 10, or various other kinds of sensors can be used, and no particular limitation is imposed thereon.

Figure 7:
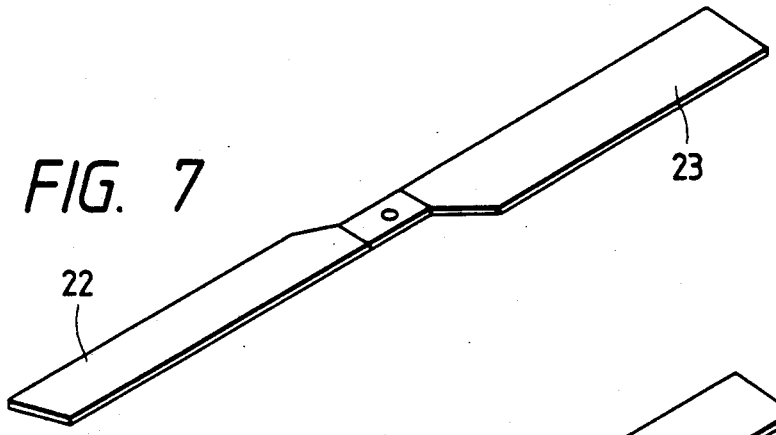
FIG. 7 is a view of a modified propeller used in the invention.

For the propeller 1, one having a plurality of blades 22 and 23 different in pitch can be used, as shown in FIG. 7. Also, there can be used a propeller having blades 24 and 25 having the same pitch but different lengths.

Figure 8:
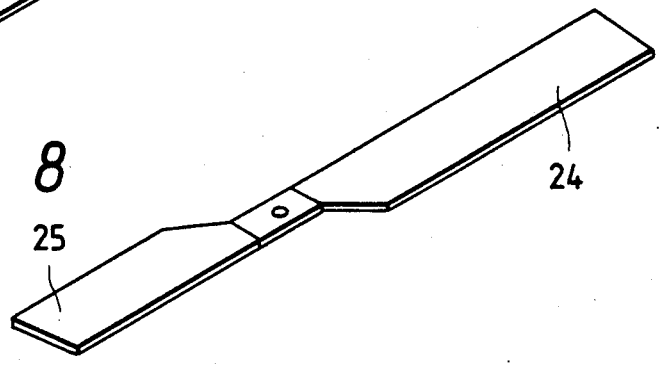
FIG. 8 is a view of another modified propeller used in the invention.
Figure 12:
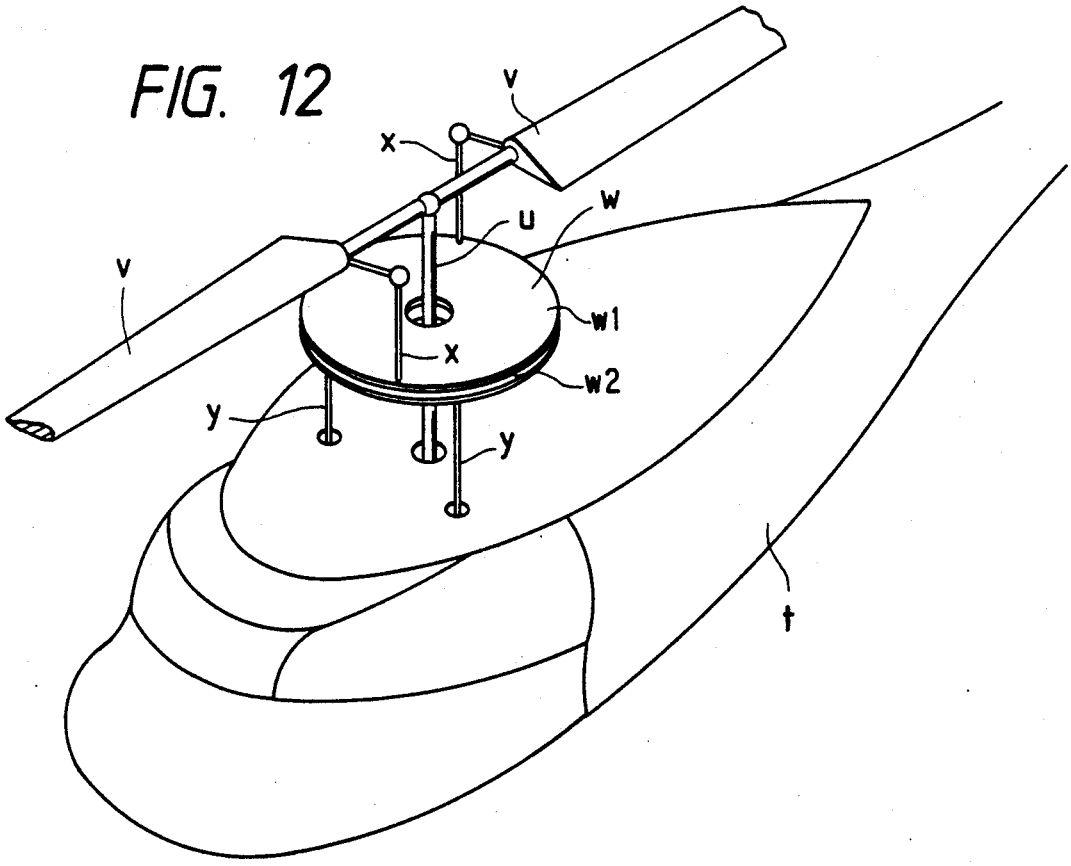
FIG. 12 is a view illustrating a prior art method of inclining the propeller rotation plane.

The propellers shown in FIGS. 7 and 8 are balanced in weight, and in either case, the angle of inclination of the propeller rotation plane can be controlled by suitably selecting the threshold values applied to the comparators 16 of the control circuit 4.

Figure 9:
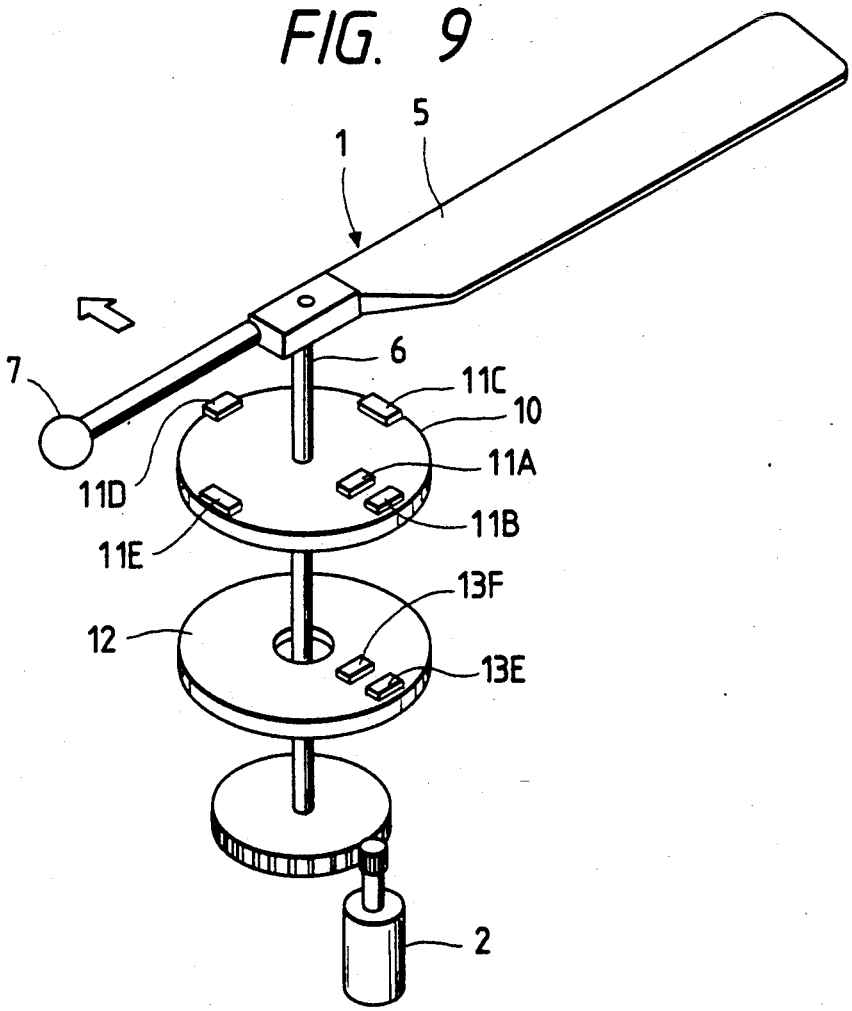
FIG. 9 is a perspective view of an important portion of a second embodiment of the invention.

FIG. 9 is a perspective view of an important portion of a second embodiment of the invention.

Those parts similar to those of the first embodiment are designated by identical reference numerals.

In the second embodiment, magnets 11B, 11C, 11D and 11E are mounted at equal intervals on a rotatable plate 10 rotatable together with a rotation shaft 6 of a propeller 1. A magnet 11A is mounted on the rotatable plate 10 and is disposed inwardly of the magnet 11B.

A magnetic sensor 13E is mounted on a fixed plate 12, and is disposed in registry with a path of rotation of the magnets 11B, 11C, 11D and 11E. A magnetic sensor 13F is mounted on the fixed plate 12 and is disposed in registry with a path of rotation of the magnet 11A.

The magnetic sensor 13E outputs a detection signal when each of the magnets 11B, 11C, 11D and 11E approaches the magnetic sensor 13E. The magnetic sensor 13E generates four pulse signals during one rotation of the rotatable plate 10. The magnet sensor 13F outputs a detection signal when the magnet 11A approaches the magnetic sensor 13F. The magnetic sensor 13F generates one pulse signal during one rotation of the rotatable plate 10.

Figure 10:
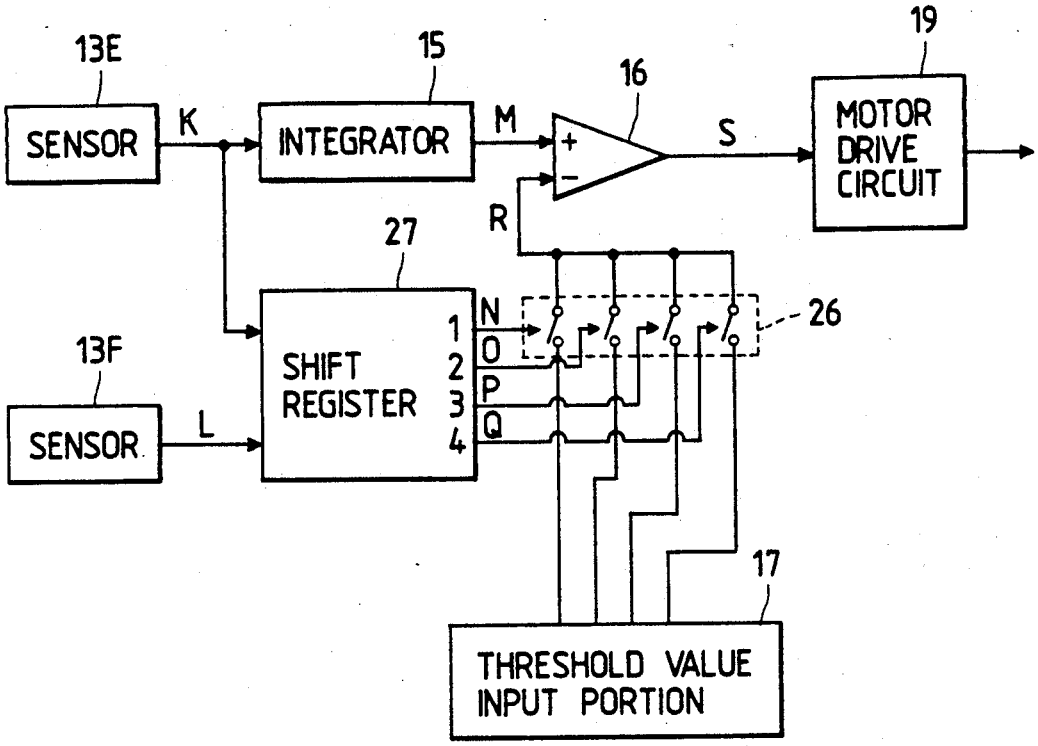
FIG. 10 is a schematic block diagram of a control circuit used in the second embodiment of the invention.
Figure 11:
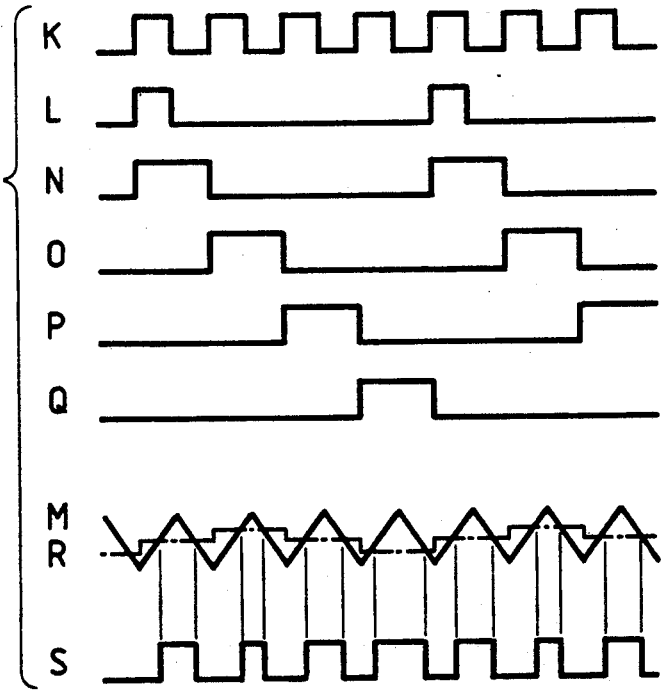
FIG. 11 is a timing chart for the control circuit of the second embodiment of the invention.

FIG. 10 is a schematic block diagram of a control circuit used in the second embodiment, and FIG. 11 is a timing chart for this control circuit.

The detection signals K and L of the magnetic sensors 13E and 13F are inputted to a clock terminal and a reset terminal of a shift resistor 27, respectively. Also, the detection signal K of the magnetic sensor 13E is converted by an integrator 15 into a triangular wave M, and then is inputted to a comparator 16.

In the shift register 27, an output pulse signal N is outputted from an output terminal 1 by a reset signal, and subsequently the pulse signal is shifted sequentially to outputs O, P and Q at output terminals 2, 3 and 4.

Threshold values corresponding to the inclination angles of the propeller 1 are inputted to the comparator 16 via an analog switch 26.

ON-OFF control of the analog switch 26 is effected by the output signals N, O, P and Q, so that the threshold value corresponding to the position of the propeller 1 is inputted to the comparator 16.

The comparator 16 converts the output signal M of the integrator 15 into a pulse signal S having a width corresponding the threshold value, and this pulse signal is inputted to a motor drive circuit 19. For example, the threshold values as indicated by a dot-and-dash line in FIG. 11 are inputted.

In this case, the threshold value for the signal produced when the blade 5 is at the front side position of the fuselage 9 is larger than the others, and the threshold value for the signal produced when the blade 5 is at the rear side position of the fuselage 9 is smaller than the others.

The pulse width is small when the blade 5 is at the front side position of the fuselage 9, and the pulse width is large when the blade 5 is at the rear side position of the fuselage 9, so that the tip path plane of the blade 5 can be inclined to the left as in the first embodiment.

The propeller blade tip path plane-inclining devices of the present invention are constructed as mentioned above, and the position of the propeller in the tip path plane of the propeller is detected, and in accordance with this detection signal, the rotation of the motor is controlled, thereby controlling the inclination of the propeller blade tip path plane.

With this arrangement, the use of a mechanism for mechanically inclining the propeller rotation plane is not needed, thus allowing a reduction in the number of the component parts, and thereby providing a fuselage of a small-sized and lightweight design.

Further, control of inclination of the propeller rotation plane can be effected using only electrical control, and therefore mechanical malfunctions are substantially eliminated, simple and accurate control can be made, and the overall cost can be reduced.

We claim:

1. A propeller blade tip path plane-inclining device for use in a toy helicopter, comprising:

a fuselage;

a propeller which is asymmetrical with respect to a rotating shaft connected to said propeller and which imparts a vertical upward propulsive force to said fuselage;

a motor fixedly connected to said fuselage and operatively connected to said rotation shaft for driving said propeller for rotation in a propeller rotation plane;

position detector means for detecting the position of said propeller in said propeller rotation plane; and a control circuit operatively coupled to said position detector means and said motor for generating a pulse signal for driving said motor, said control circuit increasing and decreasing the width of said pulse signal at predetermined regions with respect to said propeller rotation so as to incline said tip path plane in accordance with at least one detection signal from said position detector means.

2. The propeller blade tip path plane-inclining device according to claim 1, in which said propeller comprises one blade extending horizontally from said rotation shaft in one direction, and a weight projecting in a direction opposite to said blade.

3. The propeller blade tip path plane-inclining device according to claim 1, in which said propeller comprises two blades extending horizontally in opposite direction, said two blades being different in pitch.

4. The propeller blade tip path plane-inclining device according to claim 1, in which said propeller comprises two blades extending horizontally in opposite directions, said two blades being different in length.

5. The propeller blade tip path plane-inclining device according to any one of claim 1 to 4, in which said position detector means comprises:

a rotatable plate rotatable together with said rotation shaft of said propeller;

a magnet mounted on said rotatable plate; and a fixed plate to said fuselage, and having a plurality of magnetic sensors mounted thereon at equal intervals, said magnetic sensors being disposed in registry with a path of rotation of said magnet of said rotatable plate, wherein each of said magnetic sensors generates at least one detection signal when said magnet approaches each magnetic sensor.

6. The propeller blade tip path plane-inclining device according to any one of claim 1 to 4, in which said position detector means comprises:

a rotatable plate together with said rotation shaft of said propeller;

a plurality of magnets mounted on said rotatable plate; and a fixed plate fixed to said fuselage, and having a magnetic sensor mounted thereon, said magnetic sensor being disposed in registry with a path of rotation of said magnets on said rotatable plate, wherein said magnetic sensor generates at least one detection signal when each of said magnets approaches said magnetic sensor.

* * * * *